United States Patent [19]

Ordelt

[11] Patent Number: 4,936,497

[45] Date of Patent: Jun. 26, 1990

[54] APPARATUS FOR AUTOMATICALLY REMOVING AND SUPPLYING NEEDLES IN NEEDLE BOARDS

[75] Inventor: Franz Ordelt, Bubesheim, Fed. Rep. of Germany

[73] Assignee: B W F Offermann Zeiler, Schmid & Co. KG, Offingen, Fed. Rep. of Germany

[21] Appl. No.: 289,045

[22] Filed: Dec. 23, 1988

[30] Foreign Application Priority Data

Dec. 23, 1987 [DE] Fed. Rep. of Germany ..... 3743979

[51] Int. Cl.[5] ..... B21J 15/32; D05B 11/00

[52] U.S. Cl. ..... 227/5; 227/110; 227/120; 29/707; 29/710; 29/810; 112/171

[58] Field of Search ..... 29/407, 705, 707, 710, 29/809, 810, 426.1, 426.5; 112/171, 121.12; 118/37; 227/2, 5, 6, 7, 110, 111, 120; 73/864.21

[56] References Cited

U.S. PATENT DOCUMENTS

| | | | |
|---|---|---|---|
| 2,272,180 | 2/1942 | Bailey et al. | 112/117 |
| 3,026,830 | 3/1962 | Bryant et al. | 112/117 X |
| 4,125,928 | 11/1978 | Cawley et al. | 29/426.5 X |
| 4,311,484 | 1/1982 | Fosslien | 73/864.21 |
| 4,568,010 | 2/1986 | Dilo | 29/810 X |

*Primary Examiner*—Joseph M. Gorski
*Assistant Examiner*—Peter Vo
*Attorney, Agent, or Firm*—Spencer & Frank

[57] ABSTRACT

The invention relates to an apparatus for the automatic removal and supply of needles in needle boards intended for the densification of fiber webs or non-woven fabrics into needle felts in which, in conformance with a prior art method intended only to supply needles and a corresponding apparatus, the needle bores of the needle board are addressed individually, a needle is held available in front of each addressed open needle bore and this needle is driven into the open needle bore, with the tricks of the needles being oriented in the proper position for installation.

24 Claims, 6 Drawing Sheets

APPARATUS FOR AUTOMATICALLY REMOVING AND SUPPLYING NEEDLES IN NEEDLE BOARDS

BACKGROUND OF THE INVENTION

The present invention relates to a method for automatically removing and supplying needles in needle boards intended for the densification of fiber webs or non-woven fabrics into needle felts. The invention also relates to an apparatus with which this method can be implemented.

In the manufacture of needle felts made of fiber webs or non-woven fabrics, needle felt machines are employed to which the fiber web or non-woven material is fed horizontally as sheet material A needlebar is moved up and down vertically to the flat side of this sheet material on its upper and/or underside. This needlebar includes a receptacle, usually in the form of a slide guide, for a needle board. A plurality of needlebars may also be provided in succession in the direction of movement of the sheet material to accommodate successively acting needle boards, e.g. typically two such needlebars. The needle boards are provided with needle bores in a given pattern to receive the so-called felt needles which hereinafter will simply be called needles. Such needles typically have an angled portion, i.e. the trick, on the side of the needle board facing away from the sheet material which secures the needle against dropping through the needle bore and additionally absorbs the reaction pressure generated during the needle supplying process with respect to the needlebar From the one end of the trick, the so-called stem of the needle, usually in the form of a cylindrical rod, projects through the needle board and continues outside of the needle board on the side facing the sheet material in the form of a reduced shank and a needle-action end section which frequently is configured as a triangular structure ending in a point and equipped with grooves, notches or the like. Such needles are generally composed of a very brittle and thus breakage sensitive hardened metal, particularly certain steel alloys. The action of the needles in the fiber web or in the non-woven fabric densifies the latter more or less into a needle felt. With respect to details of the needling process, a needle felt machine and also typical needles employed in a needle board of the needlebar in a needle felt machine, reference is made, for example, to the monograph by Löffler, Dietrich and Flatt, entitled "Staubabscheidung mit Schlauchfiltern und Taschenfiltern" [Dust Removal by Means of Hose Filters and Pocket Filters] published by Vieweg-Verlag, Brunswick, 1984, ISBN 3-528-08566-5, pages 91–96.

Needle boards in use include a multitude of board geometries, board materials and board configurations. Older needle boards still in use are made of wood, particularly of laminated wood. Thereafter, the so-called sandwich structure was introduced in which a layer of rubber or a rubber substitute enclosed the needle stem in a friction lock and was boxed, e.g. by intermediate vulcanization, between two metal cover plates usually made of an aluminum-magnesium alloy. Recently, such three-layer sandwich structures have been formed of two-layer structures of a relatively thick metal plate, again usually an aluminum-magnesium alloy, and a thin plastic plate which is glued onto the side of the trick and now serves to hold the needle stem in a friction lock.

Depending on the manufacturer, the time of manufacture and the desired felt structure, the pattern of the needles in the individual needle boards, i.e. the pattern of the needle bores, varies in an unfathomable multitude. The most popular are the herringbone needle pattern and the random needle pattern. Although all of these needle patterns have in common that the needle pattern can be divided into imaginary rows along which the needles follow one another in a certain rhythm, it is impossible, particularly when including older needle boards, to speak of a certain given row spacing or certain distances between holes in the individual rows in an accurately preprogrammable manner. In the older needle boards, the distribution tolerances with respect to the spacing of the rows as well as the spaces between individual holes of one row are indefinite and relatively large Moreover, in the older needle boards there are needle bore deformations, particularly in their outwardly oriented end regions, often in a funnel-like shape with different tolerances in the connecting regions between these widened sections The already mentioned differences in board geometry may relate to their length, width, thickness and guide geometry of the needle board in the way it is accommodated in the needlebar. Additionally, it is sometimes customary to align the tricks in opposite directions in successive rows while in other cases they are all aligned in the same direction. Also, some needle bed manufacturers secure the tricks against rotation by providing continuous receiving grooves in the needle board in which the tricks are embedded so as to be flush with the remaining surface of the needle board. Instead, it is also known to simply embed the tricks without securing them against rotation in a flat recess on the surface on the side of the tricks so as to make them flush with respect to a projecting edge region. Otherwise, the tricks usually lie on a planar outer face of the needle board and correspondingly project relative to this outer face. Other differences in needle boards still in use may lie, for example, in the degree of aging of the needle board with respect to bending, increased tolerances in the needle bores after repeated replacement of needles and in their surface quality.

During operation of the needle felt machine, the needles are initially subjected to natural wear. Additionally, in an unpredictable manner, there occurs a more or less large amount of needle breakage so that an increasingly larger number of needles is no longer available for the needling process. For example, the triangular profile may break in the region of the needle tip or even the entire shank may break completely at a greater or lesser distance from the stem or the needle may be kinked or bent particularly in the region of the shank. As soon as a kinked needle or a needle which is bent into an oblique direction is unable to pass through the bores of the stripper plate disposed between the needle board and the sheet material being worked and/or through the perforated plate disposed behind the sheet material, it will finally be broken by one of these plates. However, needles which fail during operation increasingly worsen the quality of the produced needle felt.

Such needle destruction reduces their usability of the needle board substantially earlier than the set time at which, due to general wear, all needles should be replaced or a successive replacement of entire needle rows would be appropriate.

In the past, the replacement of individual destroyed needles has always been performed manually with machine or apparatus aids being employed for the manual activity To accomplish this, the maintenance person visually examines the needle board row by row. The remainders of individual destroyed needles in the needle bore are ejected and a respective new needle is inserted manually and then driven in. The above-mentioned machines or apparatus aids may be employed to eject and/or drive the needles in again. Ejection is effected either with a normal hammer equipped with an attachment for the needle or with a pneumatic hammer. Usually a normal hammer is employed for driving in the needle or also a device which facilitates the insertion of individual needles. An aid for the removal of needles is disclosed, for example, in DE-GM No. 1,912,670, aids for inserting needles are disclosed in DE-OS No. 1,265,426 and in DE-GM No. 83/29,050.8, particularly in its FIGS. 1 and 4.

In connection with a greater degree of automatization it has only become known to simultaneously and successively exchange whole rows of needles in a needle board. To do this, the respective needle row is ejected by means of an ejection strip which pushes out the needles or needle stumps still projecting on the working side of the needle board; an extraction strip is employed to extract the pushed-out needles on the other side, the side of the tricks, and a press-in strip for pressing new needles into the working position. However, between these steps, the needle board must be turned and the new needles must be manually inserted into the needle bores. This prior art method (see DE-GM No. 85/12,596.2 and DE-GM No. 1,923,665) therefore is only semiautomatic, insofar as the mode of operation of the mentioned individual strips is concerned and manual for turning the boards and preliminary re-insertion of new needles.

An even greater degree of automatization is known for a pure needle insertion process which is directed primarily to initially supply new needle boards with needles. Such methods and corresponding apparatus are therefore employed by the manufacturer of needle boards, but have not been accepted by the manufacturer of needle felts, particularly because the manufacturers of needle felts employ not only needle boards of a certain type but many types of different needle boards and many different hole distributions, particularly since the hole distribution can be changed by exchanging the respective needle board depending on the needle felt product desired.

Such needle insertion methods and the corresponding apparatus to be employed solely by the manufacturers of needle boards are disclosed in DE-OS No. 3,201,282 (corresponding to U.S. Pat. No. 4,568,010) and in DE-GM No. 83/29,050.8. Both processes have in common that new needles are supplied in a magazine and fed and driven in automatically. In particular, all individual, free needle bores in a row are actuated successively according to a numerical program control (DE-OS No. 3,201,282, page 13, paragraph 2) to thus equip all needle bores successively with needles. When the needles are put into the preliminary magazine, their tricks are positioned in a selected manner and the needles are then automatically supplied to the needle bores in the same or a modified trick position and are then driven into the bores. To precisely align the needles with the axis of the open bore hole, an opto-electronic receiver may be provided (DE-GM No. 83/29,050.8, page 9, penultimate paragraph) which beams into the open bore hole.

These prior art needle insertion methods and devices are hardly suitable or sometimes not suitable at all for supplying older needle boards with needles, whose original needles have already been removed, because in the older needle boards the tolerances of the needle bores change in an unpredictable manner. Moreover, the multitude of the needle boards at hand at a certain needle felt manufacturer's does not make possible without difficulty a precise numerical program control for the individual free needle bores of a certain needle board.

The above-mentioned difficulties were the reason that in the past no fully automatic process and the corresponding apparatus have become known neither for equipping needle boards with needles nor to remove the needles from a needle board. And no automatic process has been disclosed with which only individual damaged needles could be replaced with new needles.

SUMMARY OF THE INVENTION

It is therefore an object of the invention to provide a method and a corresponding apparatus with which damaged or destroyed individual needles of a needle board can be automatically replaced while leaving the remaining undamaged needles in place.

The method includes the following features:

the addressing is effected with reference to a needle bore already supplied with a driven-in needle;

in the region of the addressed needle bore, a sensor determines whether the needle disposed in the respective needle bore is still usable or is no longer usable;

if the sensor determines that this needle is usable, the next needle bore already supplied with a driven-in needle in the successive sequence is addressed;

if the sensor determines that this needle is no longer usable, a first alternative provides that instead this needle is extracted and the next needle bore already provided with a driven-in needle in the successive sequence is addressed only after an available replacement needle has been driven into the open needle bore with its trick in the proper orientation; while, according to a second alternative, the process of the sensor evaluation of the needles is decoupled from at least part of the process of replacing needles determined to be no longer usable. The method is based on DE-OS No. 3,201,282 (corresponding to U.S. Pat. No. 4,568,010) which, in contrast to the other prior art discussed, already provides for successive program controlled addressing of individual bore holes, albeit only for supplying the board with needles.

The present invention also provides an apparatus for automatically removing or supplying needles in needle boards. The apparatus includes a board receiving device and a needle supplying device which successively individually addresses the needle bores of the needle board by way of a drive and control unit. The needle supplying device includes a device for making needles available to supply them individually to an insertion plunger and to orient their tricks in the proper position. The needle removing device includes an ejection plunger on the side of the needle board facing away from the needle supplying device and an extraction device on the side of the needle supplying device and moving along with the needle supplying device. A first sensor is carried along on the side of the ejection plunger for the evaluation of a needle contained in the respectively addressed needle bore as usable or no longer usable. The apparatus also includes a selection control controlled by the sensor which, if the respective needle is considered to be usable, causes the next needle bore to be addressed. But, if the needle is evaluated as no longer usable, the control first puts the needle removal device and the needle supply device into successive operation for the exchange of a needle or causes the next needle bore to be addressed if the respective needle is evaluated to be usable or no longer usable. Additionally, if the needle is evaluated as no longer usable, the control causes the ejection plunger to be actuated if the needle evaluated as no longer usable is flush with the needle bore and brings the needle supplying device to the needle bore of the needle evaluated as no longer usable and puts the extraction device as well as the needle supply device into operation successively for the exchange of a needle.

According to the invention, it is possible for the first time to check a needle board already occupied by needles, particularly used needles, for the presence of damaged or destroyed needles and to repair it in the course of the checking by replacing such needles. This does not exclude that the means made available by the invention cannot also be put to a second use in that rows of needles are successively exchanged or needle boards not yet equipped with needles are supplied with such needles. The criterion for usability or non-usability of a certain needle disposed in a needle board may here be, for example, an opto-electronic measurement of the still existing length of a needle's projection beyond the needle board, with it, being possible, however, to refine the measurement in many ways by the use of modern opto-electronic means. For example, the respective sensor image can be compared with a desired image stored in a memory. The latter would, for example, also permit the detection of a needle in an oblique position in which case the projection length would not be significantly reduced. Relatively large oblique angles, however, can already be detected in that the sensor viewing field is set or evaluated narrowly and not tuned only to the projection length. In addition to an opto-electronic measurement, other types of sensing are also possible, for example by means of mechanical feelers.

It is novel per se to automatically individually and successively examine needle bores occupied by needles on a needle board.

The present invention makes it possible, in a manner that is simpler than the prior art manual manner, to individually replace damaged needles and to thus ensure a substantially uniform quality of the resulting needle felt. In this connection, it is of particular significance that the needle boards and the needles themselves are treated more gently than was possible in manual handling as it was customary in the past. Manual replacement of needles often causes the needle board material to be compressed or stretched, the needle bores are unnecessarily deformed and new needles are aligned incorrectly or even damaged if they are driven in manually, e.g. if they are hit at an angle. Advantageous features of the method will be described in greater detail below.

The addressing of individual needle bores already equipped with a driven-in needle can preferably be effected, if the given pattern is known, by means of a given numerical addressing program or addressing grid. This addressing grid depends on the type of needle board. For needle boards in which the needles are arranged in a herringbone pattern, the spaces, on the one hand, between successive rows of needles and, on the other hand, between the needles of each row are identical, with, however, the needles of successive rows being more or less offset relative to one another. In needle boards having a random needle pattern, the distance between successive needle rows differs in an often quite irregular sequence without repeats, while, however, the spacing of the needles within each row remains constant. Depending on the density of the needles, the spacing of rows as well as the spacing between the needles within the row changes in the herringbone pattern as well as in the random pattern. Typical measuring ranges are as follows:

needle board width: 90 to 400 mm;
needle board length: 1 to 3.5 m;
needle board thickness: 16 to 23 mm;
bore diameter: 1.09/1.46/1.58/1.70/1.82/1.94 mm;
needle spacing per row: 6 to 15, preferably 8, 10 and 12 mm;
distance between rows in the random pattern: 8 to 10 mm with a needle density of 5000 needles per running meter of board length.

In all needle boards, including those in the herringbone pattern, it can be assumed that the needle rows extend along the length of the needle board. In needle boards of the random pattern, the occupation density varies between 2000 and 15,000 needles per running meter of needle board length over the length of the needle board while for needle boards of the herringbone pattern, the needle density per running meter of needle board length generally is lower and may even fall to below 2000 needles per running meter, e.g. for preliminary densification purposes The above information does not include special configurations of only three or four rows of needles for which, however, the present invention can also be employed.

The given addressing grid preferably assumes the existence of successive rows that are spaced at varying distances, possibly in the random pattern and scans forward row by row in the likewise given respective grid spacing of the rows. These values must be given in by a program or by way of a numerical control. Even with relatively large tolerances for the needle bores, particularly in old boards, it is possible, with a sufficiently wide configuration of the effective cross sections of an automatic insertion plunger and an automatic extraction device, to fully automatically remove damaged needles detected by a sensor even if the addressing of the bore hole still containing the respective needle by way of the addressing grid constitutes only a rough approach which does not consider tolerances in the position of the respective needle bores deviating from the grid. In special cases, if the needle boards are well preserved or for which experience has shown that the addressing grid is sufficiently accurate, it is also possible to automatically insert a new needle and drive it into the needle bore during the same approach.

However, this possibility of approach is limited to the use of selected types of needle boards and is no longer sufficiently accurate particularly for old needle board types or those in which needles have been exchanged several times.

It is possible, in such needle boards, to remove the damaged needle detected by the sensor after a rough approach according to the given grid pattern. However, after removal of the needle, a further adjustment to the axis of the now open needle bore is necessary by means of a known, e.g., opto-electronic sensor follow-up which, in the case of an inadvertent coincidence of the address given by the grid pattern with the centering movement relative to the axis of the needle bore, can be used in any case as a centering check. In this way it is possible to fully automatically remove needles from and resupply a multitude of differently configured needle boards with needles and this independently of their age, their structure and other manufacturer specific particularities. Thus, the method according to the invention becomes fully usable for a needle felt manufacturer who employs needle boards from different manufacturers as well as needle boards of different ages and therefore also different structural configurations, each having a different occupation density.

It is possible to return to the old addressing grid after a certain damaged needle has been replaced. But this is connected with a loss of time if a subsequent adjustment is made only laterally to the extent of the row and thus the system must refer back to the old ideal line of the row. Preferably, the addressing grid is modified according to the follow-up adjustment after replacement of a no longer usable needle with a substitute needle, at least for a given number of needle addressing steps. This means, the system no longer advances according to the original ideal line of the needle alignment as given by the grid pattern but starts from a new, laterally offset starting point obtained by the follow-up adjustment. The row-typical steps of the grid pattern approach toward the next needle bore occupied by a needle can then remain the same even in the modified grid pattern.

If experience indicates that in a certain needle board the sum of adjustments, which depends on the sum of the tolerances of needle bores containing damaged needles, compensates itself entirely or in part within a range acceptable in operation, the respective modified pattern can be maintained over the entire length of the needle board. Otherwise, after a given number of needle addressing steps which, if necessary, may be made dependent on the number of respectively performed needle replacements, the system goes back to the original grid pattern, i.e. there is a sort of zero matching to the starting state.

In addition to this, a subsequent adjustment to the ideal line of the entire row may possibly even be done by means of a sensor and with respect to the first addressed needle bore still containing an intact needle in the respective row and thus readjust right from the start a given addressing grid pattern that is not quite correct with respect to the program or the numerical control for operation. In a borderline case, the entire rough addressing grid may initially be determined by a sensor which checks, on the one hand, the respective given row spacing and, on the other hand, the typical needle distribution per row and this pattern is then selected for the respective addressing grid.

This determination of the program by a sensor may also be effected fully automatically. This does not preclude that the address values for each needle board are selected differently, for example by prior measuring or with reference to data available from the manufacturer. The same also applies for the position of each first addressed needle per row so that the addressing grid as a whole must recognize the following parameters obtained by a sensor or otherwise: (1) starting point of scanning, e.g. first needle of the first row; (2) spacing of successive rows; (3) constant distribution in each row; and (4) starting coordinate of the first examined needle per row in a generally existing offset of needles in adjacent rows.

The method according to the invention employs for the first time, quite generally, automatic sensor means to examine successively scanned needles as to their utility or damage.

In the mentioned readjustment known means, such as, in particular, opto-electronic means, are employed as additional sensors for alignment of the system with the axis of an open needle bore.

A third type of sensor may be employed additionally if the addressing of successive bores still occupied by needles is not effected at least roughly according to a given grid pattern but according to a sensor search system. In the extreme case it may be sufficient to have a sensor scan the area of the needle bed occupied by needles in any desired sequence to cover the entire surface area and to stop for the replacement of a needle only if a so-called damaged needle is discovered, perhaps because it no longer projects sufficiently from the needle board or because it is bent or kinked. The follow-up control can then also be modified with respect to the sensor in that at least row after row is scanned but then needles that the sensor classifies as intact are skipped without the system stopping. As an alternative, the area of the needle board occupied with needles may also be scanned in a strip pattern other than the one that follows the extent of the needles. The only thing significant is that the respective addressing sensor covers, in the manner of a searchlight, all surface regions in which needles can be expected. If necessary, the spacing of needles in the row or, if the scanning takes place at an angle to the row, a modified apparent needle spacing can be given by way of a preliminary control, with the modification being determined according to a sine function depending on the obliqueness of the arrangement.

Additionally, the features of follow-up adjustment and modifying the addressing grid may be employed in this third type of sensor unless centering by means of the sensor with respect to the axis of an open needle bore obtained by the removal of a damaged needle is integrated in the sensor control right from the start.

The addressing by the sensor is not effected with respect to the needle bore but with respect to the needle, with of course the addressing of certain needles, possibly all needles, simultaneously indirectly implying addressing the associated needle bore within certain tolerances. Such an automatic needle approach per se is novel as well. If necessary, the expected locations of successive needles can be addressed in a grid pattern according to a given rough grid with a broader tolerance than customarily employed and then a general readjustment of the addressing grid can be performed or, the adjustment is made only if a needle is determined to be damaged, merely on the basis of detection of the needle by the sensor means (e.g. with reference to the switching base region including the surface of the needle bed) and not only after adjustment to the axis of an open needle bore This, too, is novel per se.

The method according to the invention permits various modifications which can be used independently within the scope of the invention but constitute, in particular, additional operating modes.

Consequently, the feature of evaluating the usability of a needle and the actions performed upon making this determination provides an alternative embodiment of the method.

According to the first alternative, it is provided that, after a sensor has determined a needle to be no longer usable, this needle is initially pulled out and replaced by a new needle before the next needle is addressed and evaluated by the sensor. This alternative of the method can be performed at relatively little expense. However, it does not consider the fact that the individual method steps require different amounts of time In particular, the successive evaluation of the needles by the sensor can be performed much quicker than the replacement of needles which becomes necessary only in some cases where the needle has been determined to be no longer usable.

The second alternative therefore provides that at least the time consuming method steps of replacing a needle that has been determined to be no longer usable by a new needle be decoupled from the successive evaluation of all needles by the sensor. The program for the sensor evaluation can here be performed early and the time consuming steps of replacing the needles are then performed subsequently only where a needle has been determined to be no longer usable. This does not preclude the coupling of the method step of removing a needle from a needle bore with the program for successive sensor evaluation if this particular process step is connected with the consumption of relatively little time. For example, a needle that has been determined to be no longer usable can be pushed back through its needle bore several, e.g. five, steps after the sensor evaluation and then this needle can be gripped at a later time, which is substantially independent of the sensor evaluation, to be pulled out of the needle bore and replaced by a new needle.

With respect to the mentioned additional operating modes it is known (applicant's internal prior art) to remove needles that are still usable, i.e. not yet damaged or destroyed and also not yet completely worn out, from a needle board for re-use, be it because the respective needle board is to be equipped with a different type of needle or the respective needle board can no longer be used due to some other damage, for example, a break in the board.

In a corresponding modification also within the scope of the invention in which the sensor evaluation of the successively addressed needles is not used for repair of the respective needle board at only the locations where there are damaged needles. Instead, all of the needles are removed from the respective needle board, with the sensor evaluation being performed, in its second application, to distinguish between and appropriately sort out damaged needles that cannot be reused from usable needles that can be employed again and to hold the latter available for reuse. If the same needle board is to be equipped with other needles, particularly needles of a different type, the method according to the invention can be employed again without modification while for boards that are not to be newly equipped with needles, the driving in of new needles is omitted.

Further additional operating modes may be directed toward the known equipping of needle boards not yet supplied with needles, i.e. to supply them with their first needles, or the known successive replacement of rows of needles. In the former case, the addressing would then have to be directed to the open needle bore in a known manner while in the latter case the steps involved in evaluating successively addressed needles can be retained but are not obligatory.

The evaluation of needles within the scope of the invention as to their usability or non-usability can be performed most easily if it is possible to perform the evaluation at least in part and possibly entirely only by means of a sensor applied from the side of the needle. In this case, it is easiest to detect broken-off needle tips, slanted or kinked needles or the like. However, the difficulty then arises that in some needle boards the spacing between rows is very close and/or is falsified by bent or kinked needles. Such a falsification can be made ineffective, perhaps during the scanning of the rows or also in a preparatory step which is part of the successive automatic method to the extent that evaluating by means of a sensor applied from the side of the needle is still possible, for example in that, at least one free space between adjacent rows is cleared simultaneously with scanning of a row. Any needle material extending into this free space and known to be very brittle can be broken off intentionally and removed. A suitable clearing tool which moves through between the rows of needles and which has a wedge or other streamlined configuration when seen in the direction of its advance can be employed to progressively clear the spaces between adjacent rows starting at the center line of the free space and moving toward the rows of needles.

As an alternative the needle evaluation may be performed exclusively at a distance from the space occupied by the needles. Although this avoids the problems connected with close and possibly falsified row spacing, it involves greater expenditures for the sensor system. By placing respective sensors at an angle, it is definitely possible to also work in the spaces between adjacent rows but to completely avoid mechanical interference. Certain sensors even permit an evaluation of the needles from the imaginary axial extension of the needle bores. This applies, in particular, for sensors in the form of laser scanners or photoelectric image comparison devices. However, such sensors can also be employed for an oblique examination direction. Additionally, it may generally be of advantage to provide different settings between examination from the frontal face and from an angle, possibly with an infinite variability or possibly also with at least two discrete positions. If a photoelectric image comparison device is employed, a desired image for a needle that can still be considered usable is stored in a photoelectric camera device and is compared on the basis of given criteria with a real photographic image of the needle to be evaluated.

In the prior art needle supplying methods and/or needle removal methods, the needle board is generally oriented horizontally. The method according to the invention is preferably performed with the needle board oriented vertically. This facilitates handling of the needle board and, in particular, the operations necessary for replacement of needles that have been determined to be no longer usable within the scope of the method of the present invention. These operations can now all be performed from two sides above a worktable.

Within the scope of the invention, it is also possible to use needles which have been placed into a magazine and in which the needles in the magazine, in a known manner, already are oriented with respect to the position of their tricks. Preferably, however, the needle board is placed upright on one of its longitudinal edges. The needles may be obtained from an unaligned supply of needles and placed successively in the desired alignment for the respectively required process of driving them into an open needle bore or a needle bore which has become open. The means required for this purpose, such as vibratory conveyors equipped with baffle plates, supply rails, grippers and insertion plungers are all structurally known per se but have not yet been specialized for the purpose of gripping needles for needle boards.

Further advantageous features of the method include inserting new needles into the needle bores during a first working step and driving the needles into their working position in a second working step. Preferably, the same gripping means are employed to extract a driven-in old needle and to insert a new needle.

The apparatus according to the invention is intended to solve the same problem, particularly to implement the method according to the invention, and is based, as is the method, on DE-OS No. 3,201,282 (which corresponds to U.S. Pat. No. 4,568,010).

While, however, the prior art of the same type relates only to a device for supplying needles, the apparatus according to the invention also includes an integrated device for removing needles Accordingly, the apparatus according to the invention is based on a needle board which is already equipped with needles and an evaluation is made by means of a sensor provided in a novel manner as to which needles are usable and which are not. Consequently, according to a first alternative, the successive removal of individual, no longer usable needles and their immediate replacement in the now open needle bore is possible before the further control of the apparatus, such as, for example, a numeric or program control, is switched to the next needle bore which is generally occupied by a needle.

According to a second alternative, the sensor evaluation of the needles and the pushing back of needles which have been determined to be no longer usable into their needle bores are decoupled before the needle is taken out of the needle bore and a new needle is inserted into this needle bore. Reference is here also made to the statements made in connection with the method of the invention.

Advantageous modifications of the apparatus according to the invention are described below.

Apparatus claims 17 to 20 and 24 represent structural solutions within the scope of method claims 7 to 10. By providing two sensor elements facing one another on both sides of a needle, the sensors are suitable to operate in the manner of a photoelectric barrier in which one sensor element acts as the transmitter and the other as the receiver; specifically, the embodiment may be employed as a so-called bifurcated light barrier.

In the prior art apparatus of this type as well as in other comparable prior art devices the needle board to be worked by machine is disposed horizontally on the associated board receiving device. This offers the possibility right from the start to employ needle boards of different lengths, thicknesses and widths on the respective work table constituting the board receiving device.

One particular problem exists if the needle boards are more or less bent through, for example due to deformation of the surface in operation. Therefore, one modification the invention provides a way to straighten the needle board even in such a case, at least for the process of removing and resupplying needles and thus to ensure uniform operating conditions for the needle removal and supply devices. Another modification provides an alternative solution of this problem which is particularly suitable for needle boards which are difficult to straighten out.

Another embodiment provides an at least one-sided mutual reinforcement of the frame portions which carry the needle removal and supply devices and are moved relative to the frame of the apparatus in the course of the successive addressing of individual needle bores and of the needles contained therein. This reinforcement absorbs the generated reaction pressures.

Yet another embodiment divides, in a suitable manner, the follow-up control, on the one hand, into a movement of the portal for the purpose of stepping off a needle length and, on the other hand, into a movement of the needle removal and supply devices relative to the portal, more advisably for the purpose of advancing from one needle row to the next. However, these movement functions may also be reversed or possibly the direction of advance may also be selected, to be transverse or oblique to the given needle rows of the needle board. Instead of the portal configuration, other equivalent reinforcement means may also be provided between the carriers for the needle removal and supply device which are displaceable on both sides of the needle board.

The needle removal device, the needle supply device and the first sensor for needle evaluation may be attached at a common portal. However, equivalent reinforcements can be obtained, with greater overall expenditures for drives and controls but more favorable cadences, if the stated devices including the sensor are divided into a plurality of portals. It would also be possible to distribute the sensor and the ejection plunger themselves to separate, decoupled portals so that a total of three (or more) portals are adjustable. However, because of the again higher costs for drive and controls, this appears to be justified only for particularly high demands for fast cadences The first portal, equipped with at least the needle supply device, is preferably brought from the last working position only on demand or it follows in synchronism with the second portal (which carries the sensor).

In the prior art apparatus of this type, the needles are initially placed into magazines and are fixed in the individual magazines right from the start with their proper trick orientation When a board is supplied with new needles, such a magazine must therefore always be exchanged for the next one after a given number of needle supply processes. On the other hand, a needle can be driven into the needle bore by means of an insertion plunger directly from such a magazine without requiring a separate preliminary insertion process.

In a preferred embodiment, a gripper is provided instead which takes over such a pre-insertion function. Additionally, the gripper preferably additionally performs, as a second gripper function, the function required according to the invention of pulling out a needle, particularly a needle which is no longer usable and which had previously been pressed in from the other side of the board.

This does not exclude, within the scope of the invention, use of the gripper only to pull out needles and to proceed with the insertion of needles in the conventional manner, be it by using a preliminary magazine, be it by means of a conventional supply device, for example a pusher performing a linear or rotary or pivoting movement.

If the gripper is attached to a pivotal head, its pivoting movement can be employed to eject a respective old needle as well as to pick up a new needle for insertion. If then the pivotal head also carries the bore coordinate sensor with which a follow-up adjustment relative to the axis of the free needle bore is controlled, it is possible to align the bore coordinate sensor with the needle bore when the pivotal head is in a position in which the gripper is pivoted away from the needle bore and to thus perform a follow-up adjustment relative to the axis of the free bore between removal of the old needle and insertion of the new needle since it is desirable for the insertion of the new needle to have the most accurate possible alignment with the open needle board within relatively close tolerances.

As already considered in the present invention with respect to its species, it is customary, due to the relatively narrow spacing of the needles in the needle board, to orient the needles with their tricks in a certain direction. In this connection it should at least be avoided that the tricks of the needles of adjacent needle bores come to lie on top of one another. Two types of trick orientation are customary In the one orientation which is sufficient for relatively low-quality needle felts, all tricks are oriented in the same direction. With such identical orientation of the tricks, the relatively low-quality product usually has an optically discernible structure which is undesirable in higher-quality needle felts. It is therefore customary to orient the tricks in alternatingly opposite directions from needle row to needle row always along the respective row so that even in highly densified needle boards equipped with a large number of needles, closer spacing between rows is possible than the spacing of needles in the respective row (particularly for the random pattern system). The apparatus may also be modified so it is possible to supply all needles with a uniform orientation of tricks and to finally align them for the needle board by correspondingly rotating the gripper about its action axis after it has taken up the pre-oriented needle.

In another embodiment the specific magazine arrangement is replaced with the possibility of continuously supplying new needles as long as the vibratory conveyor is kept full with needles.

The invention will be described in greater detail below with reference to several embodiments which are illustrated schematically in the attached drawing figures.

DESCRIPTION OF THE PREFERRED EMBODIMENTS

Figures 1, 1A, 1B:
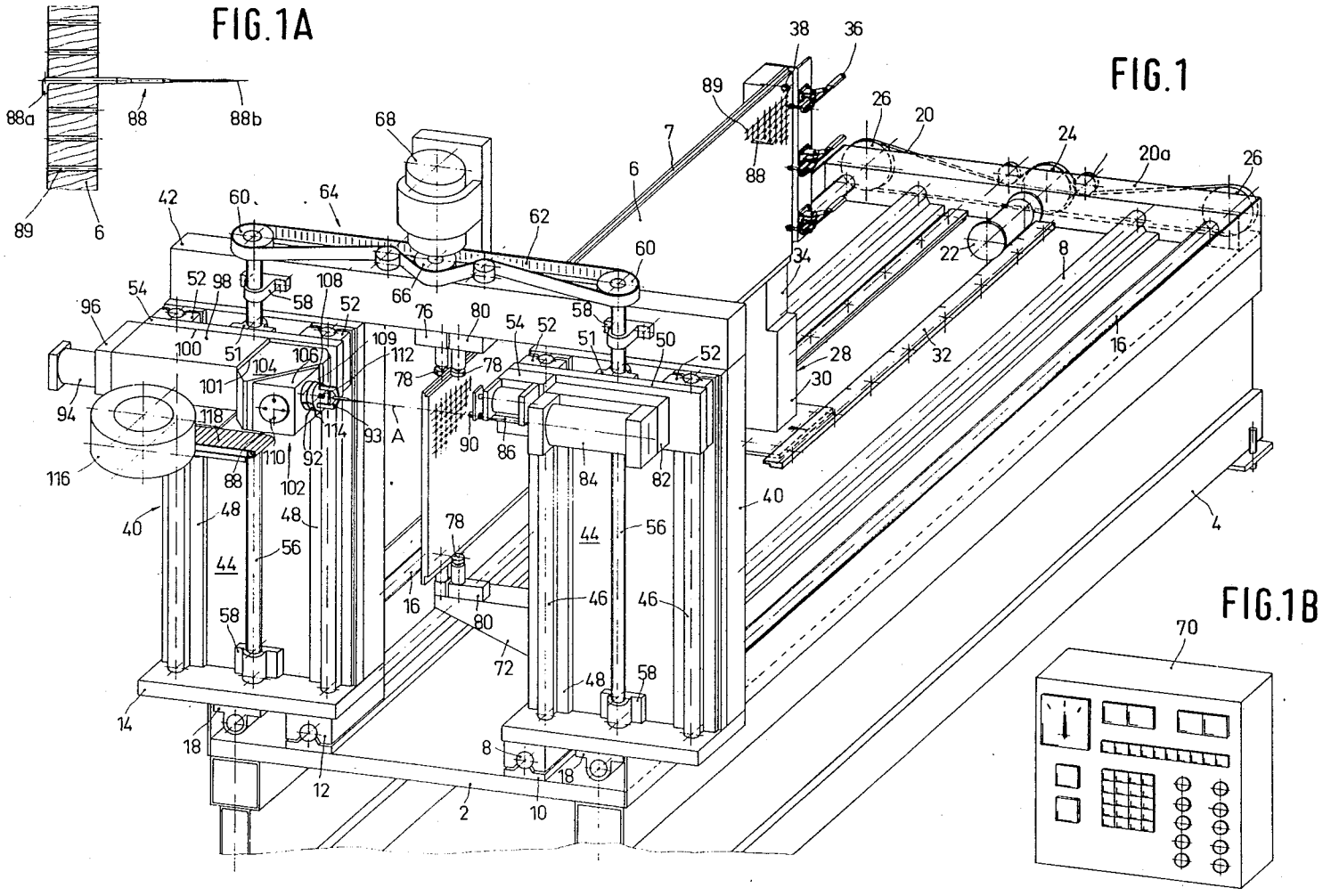
FIG. 1 is a perspective view of part of an apparatus for the fully automatic removal and supply of needle boards by successively working individual needle bores occupied with needles, with FIG. 1*a* showing a needle in a needle bore (in phantom lines) and FIG. 1*b* separately showing a driving and control unit.
Figure 2:
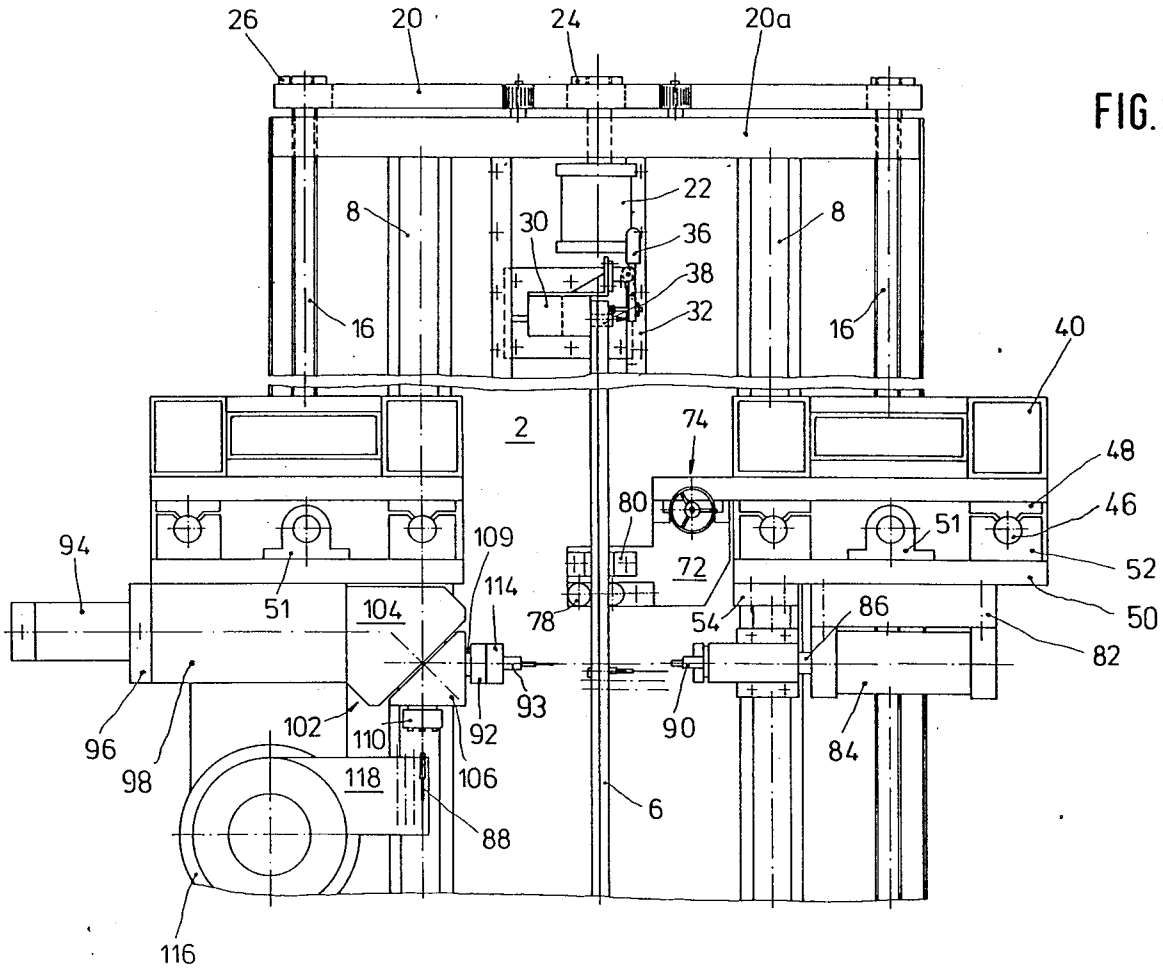
FIG. 2 is a top view essentially of the part of the apparatus shown in FIG. 1.
Figure 3:
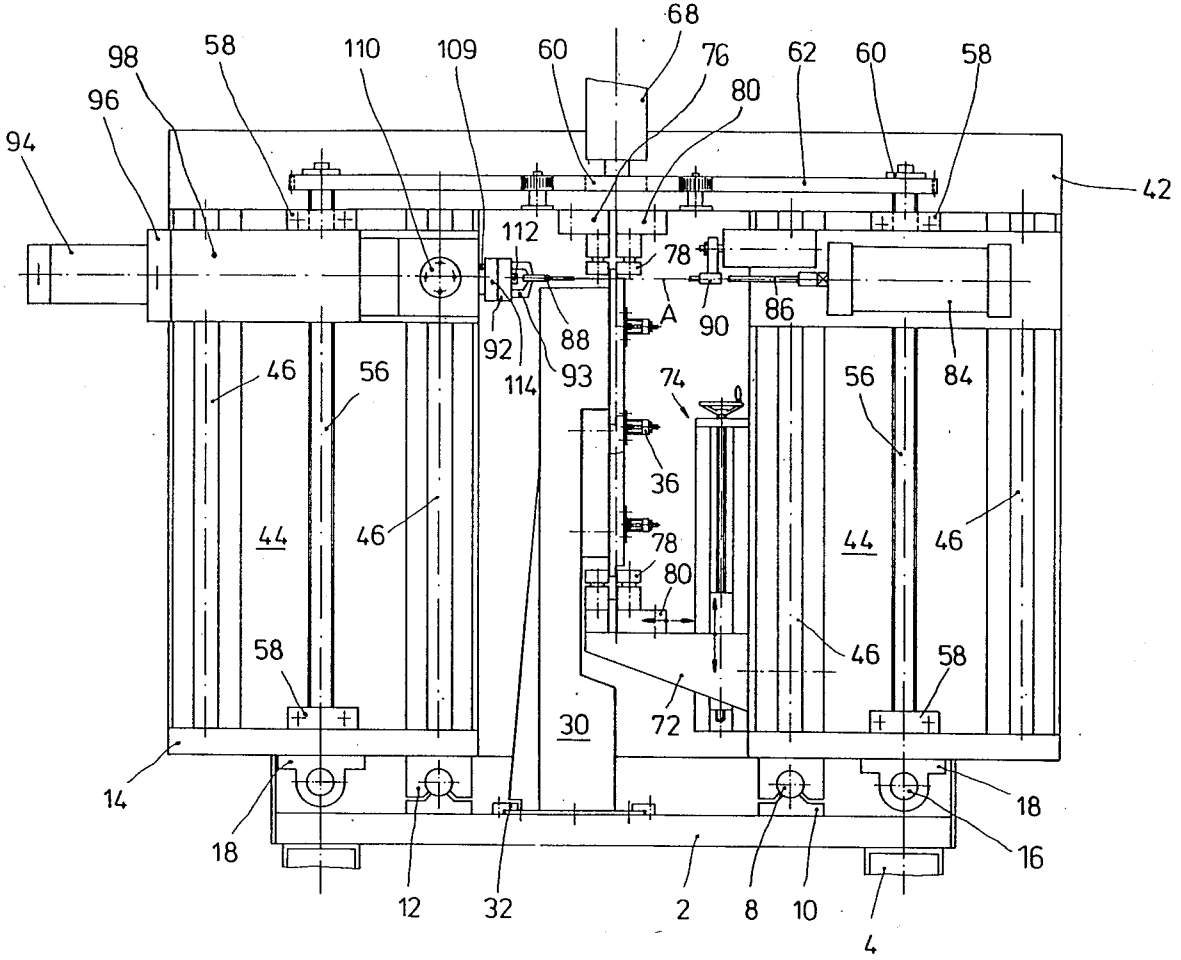
FIG. 3 is a side view of essentially the same part of the apparatus seen along the board receiving device toward the portal visible in FIG. 1.

The apparatus shown in FIGS. 1 to 7 in the form of a fully automatic machine includes a base plate 2 which constitutes the horizontal upper side of a basic frame 4 resistant to twisting. Base plate 2 has a greater length than the maximum length of the needle boards 6 to be worked. These needle boards may have a longitudinal edge configuration which includes, for example, a flanged side 7 which is complementary to a slide guide in the receptacle of a needlebar in a needle felt machine. The needlebar receptacle may here possibly accommodate more than one needlebar, one behind the other in the longitudinal direction, with the frontal faces of adjacent needlebars possibly being blunt or equipped with complementary profiles For reinforcement reasons, the basic frame is advisably configured as a box which is constructed of twist-resistant rods forming a framework of essentially the same length and width as the extent of base plate 2.

Laterally spaced from both longitudinal edges of base plate 2, there extends along each one of these longitudinal edges a guide shaft 8 which has a solid cross section and is fastened to base plate 2 by way of shaft brackets 10. A linear ball bearing 12 fastened rigidly to a common second base plate 14 moves on each one of these guide shafts 8. Therefore, second base plate 14 is therefore displaceable on guide shafts 8 along first base plate 2.

Displacement is made possible by threaded spindles 16 which engage in respective traveling nuts 18 that are fastened below the common second base plate 14. The two threaded spindles 16 are driven at one frontal end of base frame 14 above base plate 2 by a common toothed belt drive 20 and a stepping motor 22. Stepping motor 22 must be controllable so as to not only permit constant step widths but also corrections of the steps by way of subsequent adjustments. The toothed belt of the toothed belt drive advisably has a fine pitch with the tightest possible form-locking engagement in the toothed drive wheel 24 driven by the stepping motor and not identified in detail and with the two toothed driven wheels 26 which are each fastened to one end of each threaded spindle 16. In the customary manner, additional guide and tensioning elements may be provided for toothed belt drive 20.

Threaded spindles 16 extend parallel along guide shafts 8, in the illustrated embodiment in the transverse direction of the base plate further toward the exterior.

First base plate 2 is also provided with a board receiving device 28 which is stationary during operation of the apparatus. This device includes, in the region of one end of the base plate, an upwardly projecting support 30 which is adjustable along the base plate by means of a length adjustment device 32 and serves to grip one narrow side of a needle board 6 A corresponding support (not shown) in the region of the other end of the base plate which, however, is fastened to base plate 2, serves to grip the other narrow side of the needle board. Length adjusting device 32 permits the accommodation of needle boards of different lengths in the same board receiving device 28.

As can be seen in the drawing figures, needle board 6 is put upright on its lower longitudinal edge. Support 30 is here provided with a contact surface 34 for the one flat side of the inserted needle board. Quick-action clamps 36, three of which are distributed over the width of the needle board in the embodiment of FIG. 1, press against this contact surface 34 by engaging at the other flat side of the upright needle board. The height of the needle board is set by way of a positioning pin 38 which engages in a receiving bore (not shown) of support 30. Contact surface 34 extends downwardly from the reference point given by positioning pin 38 to such an extent that all possible needle board widths are able to rest on it. Correspondingly, quick-action clamps 36 are suitable to clamp in all possible needle board thicknesses.

On both sides of board receiving device 28, the second base plate 14 is provided with pillars 40 which, by way of an upper traverse 42 parallel to base plate 14, are combined to form a U-shaped portal which, in turn, forms a stiff frame together with second base plate 14.

A parallel pair of vertical guide shafts 46 each fastened by way of a shaft bracket 48 to the respectively associated side piece 44 in the region of its outer longitudinal edges when seen in the transverse direction extends at the outer frontal side piece 44 of each of the two pillars 40 with a relatively large distance between each pair.

A vertical first receiving plate 50 at the pillar 40 shown on the right in FIG. 1 is vertically displaceable along the outer side piece 44. Correspondingly, on the second pillar 40 shown on the left in FIG. 1, a second receiving plate 54 is vertically displaceable along the outer side piece 44 of this pillar, and thus parallel to the first receiving plate 50, by means of corresponding linear ball bearings 52.

Respective threaded spindles 56 are provided to displace the two receiving plates 50 and 54 and are held so as to be rotatable but not displaceable by way of bearing brackets 5 parallel to guide shafts 46 centrally between the guide shafts on the respective receiving side piece 44. Corresponding bearing bracket functions with respect to threaded spindles 16 can be taken over by a traverse 20a which here, for the sake of simplicity, is counted as part of toothed belt drive 20. This traverse 20a is fastened to first base plate 2.

The first and second receiving plates 50 and 54 are each rigidly connected with a traveling nut 51 which moves on the respective threaded spindle 56 and is displaced in the longitudinal direction of the threaded spindle when the latter rotates. The arrangement is here such that the two receiving plates 50 and 54 are displaced in synchronism with one another when a second stepping motor 68 is actuated.

A toothed driven wheel 60 is fastened to the two upper ends of each threaded spindle 56 and engages in a toothed belt 62 which has function characteristics with respect to the form-locking engagement and the avoidance of play and delay corresponding to the first toothed belt drive 20. Toothed belt 62 meshes with a toothed drive wheel 66 of a second stepping motor 68 which, like the first stepping motor 22, permits follow-up adjustment of its normal stepping width. Therefore, identical stepping motors may be employed. Both stepping motors are operated by a program controlled or otherwise numerically controlled known electronic or possibly also electromechanical servo mechanism which is indicated at the bottom right of FIG. 1 of the drawings and is included in the drive and control unit 70 shown as a control box. It includes in particular, a drive and control for the two stepping motors for the successive addressing of individual needle bores of the needle board and the needles contained therein including the selection control required to implement the method according to the invention. Additionally, it also includes electrical or electromechanical means for follow-up adjustment of the two setting motors so as to axially align the needle supply device to be described below with an open needle bore. The sensors will be discussed further below.

At one of the two pillars 40, here at the pillar on the right in FIG. 1, a support 72 is mounted whose vertical position is adjustable by means of a height adjustment device 74 to adapt it to the width of the respective needle board 6 to be accommodated. Except for its adjustability in height, support 72 is immobile relative to its pillar 40.

A holding block 76 is fastened below the center of traverse 42. A pair of guide rollers 78 is rotatably mounted at support 72 and another pair at holding block 76. By means of an adjustment device 80, the spacing of the respective pair of guide rollers can be set to adapt it to the thickness of the needle board to be accommodated. The two pairs of guide rollers each pass around a longitudinal edge of the upright inserted needle board and, if portal 40, 42 is displaced longitudinally, they roll over needle board 6 along first base plate 2. These rollers are provided to hold needle board 6 in the region of portal 40, 42 so that longitudinal bends impressed into the needle board are compensated. Together with the rigid mounts of the inserted needle board 6 in the region of its end edges, the pairs of guide rollers 78 thus form a third support which determines the position of the needle board in the working region of the needle removal and supply devices (to be described below) transversely to base plate 2.

Two holding blocks 82 spaced from one another are fastened to the first receiving plate 50, and the frontal face of a pneumatic setting member 84 for an extraction plunger 86 is fastened between them. Any other suitable prior art setting member may take the place of pneumatic setting member 84, e.g. a hydraulic or electromechanical setting member.

Ejection plunger 86 here projects through a bore (not shown) in inner holding block 82 and is aligned to be flush with the action axis A (shown in dot-dash lines) of the needle removal and supply operation. A first sensor 90 here arranged at a distance from an imaginary tangential plane at the tips **88*b* of needles 88 in needle board 6 is offset a few steps in the direction of a row relative to this action line A so that the sensor is able to scan a needle which is, for example, three steps ahead before the needle removal and supply device reaches the location of this needle and its needle bore. This first sensor 90 serves to check needles for usability or non-usability. Instead of the rigidly offset arrangement, a pivotal arrangement (not shown) may also be provided in which the first sensor 90 is arranged in action axis A before ejection plunger 86 is actuated and is then pivoted back for actuation of ejection plunger 86**.

Alternative configurations of first sensor 90 will be described below with reference to FIGS. 4 to 6 and 8.

As can be seen in FIG. **1*a*, a needle 88 is accommodated in a needle bore 89. On the needles, their tips 88*b* are identified as well as their tricks 88*a*** which are disposed at the opposite end.

On the other side of needle board 6, in action axis A, there acts a gripper 92 which can be moved back and forth along axis A by means of a pneumatic or otherwise configured setting member 94. A first function of gripper 92 is to grip the needle pushed toward the left by ejection plunger 86 through the needle bore of the needle board of FIG. 1 and pull it out of needle board 6. When gripper 92 opens again, the extracted needle may be dropped into a receptacle (not shown). Gripper 92 in this first function and ejection plunger 86 constitute the two active elements of a needle removal device operating from hole to hole.

In its second function, the insertion of new needles into needle bores 89 that have become open, the gripper is also part of the needle supply device to be described in greater detail below.

A second setting member 94 is fastened to the second receiving plate 54 by way of a holding plate 96 which extends vertically outwardly from second receiving plate 54. The second setting member 94 here serves to displace a carriage unit 98 along action axis A on guides 100 at second receiving plate 54. At its frontal face 101 facing needle board 6, carriage unit 98 is provided with a pivot head 102 composed of a base member 104 rigidly connected with the frontal face 101 of carriage unit 98 and of a pivotal member 106 which is rotatable relative to the base member. Base member 104 has the shape of a house and the pivotal member has the shape of a triangle, with their base faces 108 lying against one another. If these base faces 108 are rotated relative to one another, pivotal member 106 can be rotated relative to base member 104 between two end positions about an axis oriented at an angle of 45° with respect to action axis A. In the one end position, gripper 92 is aligned with action axis A, in the other end position, a bore coordinate sensor 110 provided as the second sensor is aligned with action axis A.

Gripper 92 is preferably configured as a so-called two-finger gripper which is suitable to grip a needle at its stem portion behind the trick from two opposite sides, possibly by gripping around it.

Figure 6:
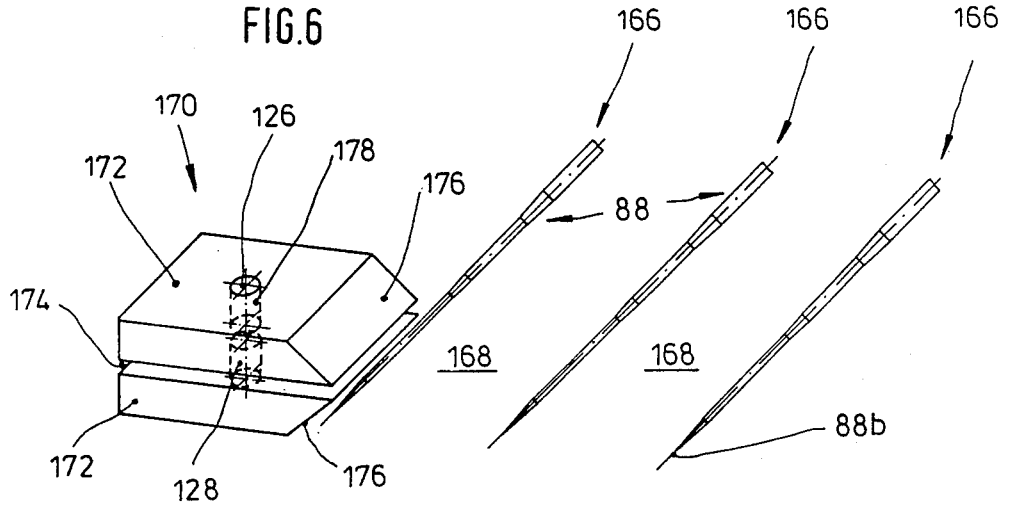
FIG. 6 is a view of a removal device including a sensor which operates in principle as in the embodiment of FIG. 4.

Bore coordinate sensor 110 is preferably provided in a known manner with transmitter and receiver means which are inclined at an acute angle to one another so that it is possible for the sensors to scan the free cross section of a needle bore from one side (see DE-GM 83/29,050.8, particularly its FIG. 6 and page 9, penultimate paragraph).

An insertion plunger 112 is coaxially guided in gripper 92 and can be actuated by a third, preferably pneumatic, setting member 114. Insertion plunger 112 together with gripper 92 (in its second function) constitute the essential elements of the needle supply device.

After a needle 88 is preliminarily inserted by gripper 92, its fingers open far enough for insertion plunger 112 in gripper 82 to be extended and carriage unit 98 moves further on action axis A to press in needle 88 until its trick 88*a* lies against the surface of the board.

One possible embodiment of the gripper will be described below with reference to FIG. 7.

The opening of gripper 92 may be controlled by end switches (not shown) in dependence on the assumption of the advanced or retracted position of carriage unit 98 by way of gripper actuation means which are not described in detail here.

A vibratory conveyor 116 is fastened to carriage unit 98 and is able to receive a supply of initially unordered new needles. In a conventional manner not shown here in detail, this vibratory conveyor is provided with an outlet in which the needles can be separated and their tricks oriented in the same direction. The separated new needles 88, with their tricks oriented in the same direction, are deposited transversely on a, for example, belt-type linear conveyor 118 which is advanced one step at a time by a stepping drive (not shown) whenever a new needle is to be driven in. The respectively last needle is then made available for immediate takeup by gripper 92 which is able to grip the needle in a position pivoted out of action axis A. Like vibratory conveyor 116, linear conveyor 118 is fixed to carriage unit 98. This permits the continuous supply of new needles. Since these needles have their tricks oriented in a constant manner, the gripper can be rotated about its axis—which in the needle supply mode is flush with action axis A—in pivot member 109, particularly about 180°, so as to be able to set the trick orientation to be alternating during the needle supplying process, particularly with a change of 180° from needle row to needle row.

Figure 4:
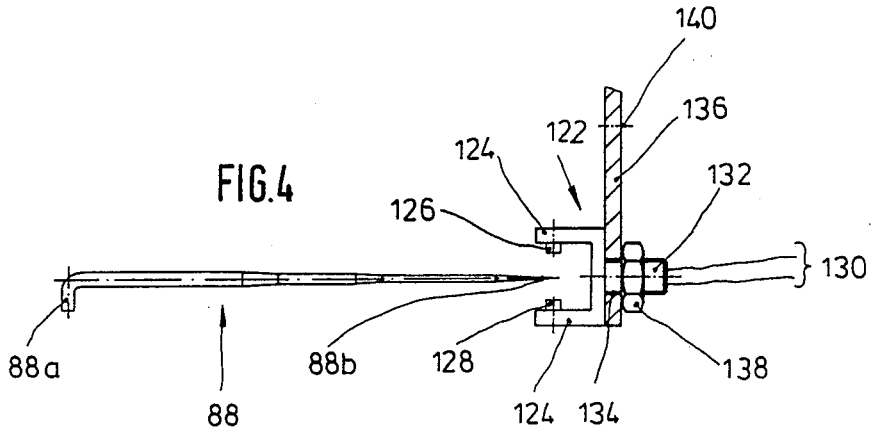
FIG. 4 is a partial sectional view of a first embodiment of a sensor for determining the usability of a needle.

Let us now discuss a few already mentioned components of the apparatus in greater detail FIG. 4 shows an embodiment of first sensor 90 with which the usability of needles 88 is determined. It is an opto-electrical measuring instrument in the form of a so-called bifurcated photoelectric barrier. For this purpose, first sensor 90 is provided with a fork 122 which has essentially a U shape. Two sensor elements 126 and 128 face one another at the two arms 124 of fork 122, for example the transmitter and receiver of the photoelectric barrier. Alternatively, the one sensor element may combine the transmitter and receiver functions with one another and the other sensor element may only perform a reflecting function. For example, sensor elements of an infrared light barrier are suitable here.

The spacing between the two sensor elements 126 and 128 has been selected in such a way that the tip 88*b* of the respectively checked needle (whose other end is its trick 88*a*) can be checked for presence or absence without contacting it. Depending on the degree of coverage of sensor elements 126 and 128 beyond the tip end of the needle, the examination may here be set in such a way that the needle is either checked only for the absence of its tip or also for the absence of longer tip sections. This can easily be done by a suitable selection of the length of tines 124 of fork 122 and by corresponding placement of the photoelectric barrier relative to needle 88. Such optical light barriers are of the type which is available commercially; they convert their optical signals to electrical signals which are transmitted for further processing by a pair of electrical conductors 130 (indicated only) to drive and control unit 70.

Fork 122 has a body 132 which passes through an opening 134 in a holding arm 136 and is provided with an external thread onto which a nut 138 can be screwed. In its installed state, holding arm 136 is firmly gripped between nut 138 which lies against it on one side and the planar back of fork 122. Holding arm 136 has a fastening point 140 for fastening the first sensor 90 at a suitable location in the apparatus. Instead of fastening means, a drive device may be provided selectively to push the sensor forward and back in the desired manner.

Figure 5:
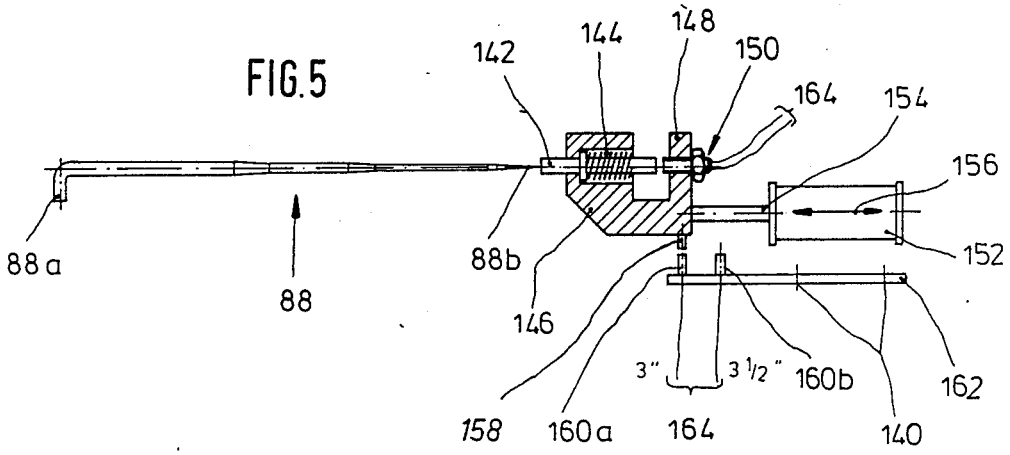
FIG. 5 is a partial sectional view of a second embodiment of a sensor for determining the usability of a needle.

Alternatively, the second sensor 90 may also be configured differently, e.g. as a mechanical feeler according to FIG. 5.

In the mechanical feeler according to FIG. 5, a feeler pin 142 is arranged coaxially with the axis of needle 88 and is pre-tensioned in the direction of the tip of needle 88 by a weak compression spring 144 housed in a slide bearing member 146 for feeler pin 142, which may also be a roller bearing member. Slide bearing member 146 includes a bent arm 148 in which a proximity switch 150 operating without contact is fastened so as to be axially spaced from the end of feeler pin 142 facing away from needle 88.

A double-action setting cylinder 152 which may be operated in any desired known manner, e.g. pneumatically, hydraulically, electromechanically or the like, has its piston rod 154 connected with slide bearing member 146 and is able to push slide bearing member 146 back and forth according to the double arrow 156 in the axial direction of the needle 88 fastened in needle board 6. In this connection, two displacement strokes will be distinguished in practice and, as shown in FIG. 5, these correspond to the conventional lengths of needles 88 of either 3" or 3½" available in the trade. During this displacement, a marking element 158 fastened to slide bearing member 146 moves relative to two proximity switches **160*a* and 160*b*, also operating without contact, of which the former is associated with the 3" needle length and the latter with the 3½" needle length. The two proximity switches 160*a* and 160*b* are fastened to a holder 162 which extends parallel to the needle axis and to the stroke of the feeler pin. Proximity switch 150 and proximity switches 160*a*, 160*b* in turn are connected by means of electrical lines 164 with drive and control unit 70. At two fastening locations 140, holder 162 is connected, as is setting cylinder 152, with a holding arm (not shown) of the type of holding arm 136 of the embodiment of FIG. 4 and the same statements made in connection with FIG. 4** apply here for the fastening and adjustability of the holding arm.

The stroke of adjustment cylinder 152 according to double arrow 156 and also the stroke of feeler pin 142 is set to the type of needle employed, i.e. depending on whether the needle is a 3" needle or a 3½" needle. Accordingly, proximity switch **160*a* or proximity switch 160*b*** is put into operation.

If marking element 158 reaches proximity switch **160*a* or, alternatively, proximity switch 160*b*, the feeling stroke is reversed. If the feeling pin is pressed in in the end position, proximity switch 150 reports the presence of a still usable needle 88 since then the needle tip 88*b* or at least a needle portion behind the tip has caused the feeler pin to perform a sufficiently long rearward movement against compression spring 144 and thus to cause proximity switch 150** to emit a signal Otherwise the needle is no longer usable.

FIG. 6 shows three needles 88 which are representative of a corresponding plurality of needle rows 166. Between each one of these rows there is a space 168 into which a clearing member 170 can engage. Clearing member 170 is equipped with two spaced-apart jaws 172 which as a whole are configured as elongate, rectangular blocks The two jaws 172 are spaced at a distance 174 which is greater than the diameter of a projecting tip end of a needle 88 fastened in the needle board so that the needle can be received between the two jaws To facilitate the engagement, the engagement ends 176 of each jaw 172 are sloped so that the two engagement ends 176 together produce a wedge-shaped configuration at clearing member 170.

A bore 178 extends transversely to jaws 172. Oppositely disposed sensor elements 126 and 128 of the type of the corresponding sensor elements in the arrangement of FIG. 4 are fastened in this bore so as to face one another in the two jaws 172.

Upon approach to needle bores 89, clearing member 170 is carried along by a mechanism not shown in detail and thus engages in the space between two rows of needles to clean them of broken parts that might still be disposed there and particularly of those needle elements which have been bent and kinked already but have not yet broken off. Thus the sensor measurement by means of the first sensor 90 becomes fully effective The clearing action may here be leading somewhat as indicated by the combined arrangement according to FIG. 6, or it may take place in combination with the evaluation by first sensor 90. As described above, the evaluation by means of first sensor 90 may take place before the actual work location is reached and the result may be stored electronically or in some other manner.

Figure 7:
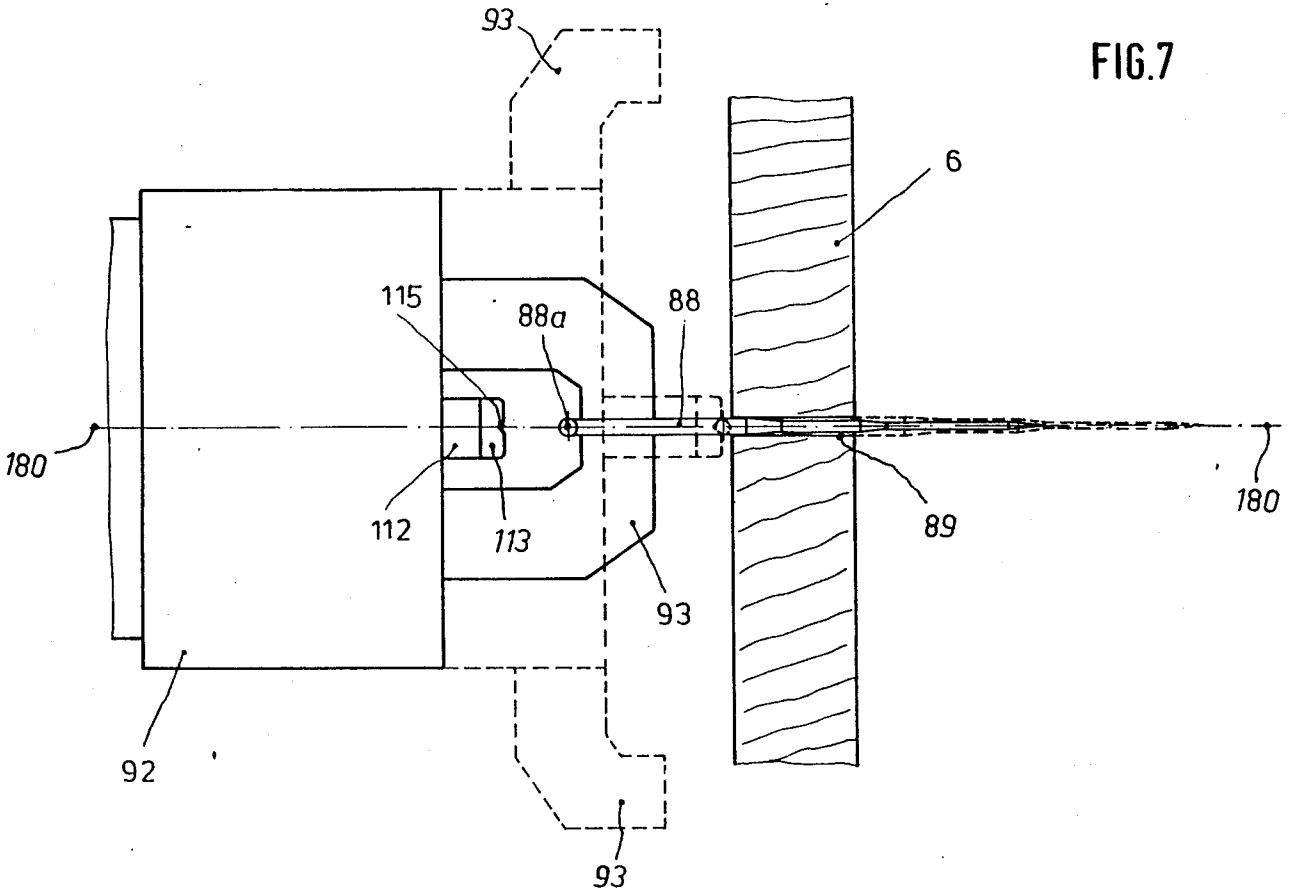
FIG. 7 is a view of a gripper with associated needle board and a needle to be pressed thereinto.

Finally, FIG. 7 shows a possible embodiment of a gripper 92 to show its manner of operation for the insertion of a needle 88 into a needle bore 89 that has become open or is open in a needle board 6.

The action axis 180 of gripper 92 here coincides with the axis of needle bore 89. Insertion plunger 112 is displaceable along this action axis Two or more gripper fingers 93, for example three gripper fingers uniformly distributed over the circumference, grip around the insertion plunger. Gripper fingers 93 are shown in dashed lines in a pivoted-out position and in solid lines in a position in which they grip a needle 88. The movement of gripper 92 relative to needle board 6 and a further position of insertion plunger 112 are here shown in dashed lines. The advance produced by the relative displacement is effected by way of carriage unit 98.

Insertion plunger 112 includes a magnetic head 113 which is additionally provided with a receiving notch 115 for the trick **88*a* of needle 88**.

The arrangement operates as follows: with gripper fingers 93 closed, carriage unit 98 advances gripper 92 to place needle 88, into needle bore 89.

Then insertion plunger 112 moves out and, by means of the receiving notch 115 of its magnetic head 113, fixes the preselected trick position of the needle. Then gripper fingers 93 open into the position shown in dashed lines and carriage unit 98 pushes needle 88, by way of base member 104, pivoting unit 106, gripper 92 and insertion plunger 112, finally into needle bore 89. In the end position, trick **88*a* then lies against the surface of needle board 6 facing gripper 92, as shown in FIG. 7 by the arrangement of trick 88*a* between the image of insertion plunger 112 shown in dashed lines and the illustration of the surface of needle board 6** shown in dashed lines on the left of the drawing plane.

The apparatus described above with reference to FIGS. 1 to 7 can be modified in various directions as will be described below for a second embodiment and with reference to FIG. 8.

Figure 8:
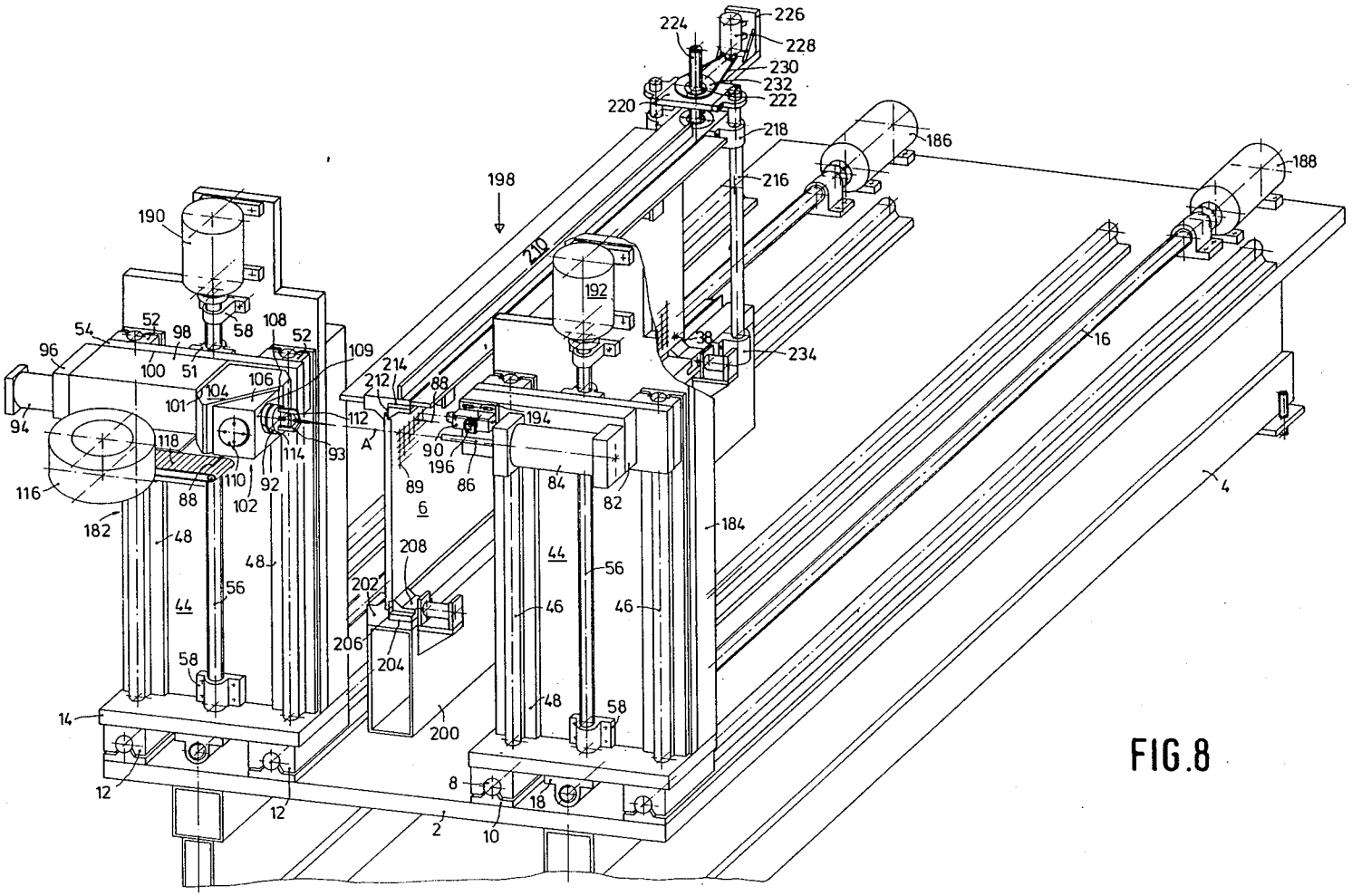
FIG. 8 is a view according to FIG. 1 of an alternative embodiment of the apparatus illustrating various possibilities for modifying the apparatus according to FIGS. 1 to 7.

FIG. 8 corresponds to the illustration of FIG. 1 with, however, a plurality of function units having been modified. These modifications may be provided individually, in groups or all together If hereinafter nothing specific is disclosed regarding these modifications, the remaining function units correspond to the apparatus described above with reference to FIGS. 1 to 7.

According to a first differentiating feature, the pillars 40 of the first-described apparatus are each replaced by a first portal 182 and a second portal 184, respectively, each of identical configuration and possibly further reinforced, on both either side of the needle board. These portals are no longer connected transversely across the needle board by a traverse 42 but are merely provided, advisably but not necessarily, with transverse reinforcements behind their now individually associated outer side pieces. Correspondingly, the pillars are also disposed on individually associated second base plates 14 which are now each guided along the needle board on two parallel guide shafts 8. The type of guidance corresponds to that of the first-described apparatus. Additionally, the sole first stepping motor 22 of the first apparatus is replaced appropriately by two separate first stepping motors 186 and 188, respectively, each actuating, by means of a threaded spindle 16, the independent displacement of the two portals 182 and 184 along needle board 6.

Likewise, the sole second stepping motor 68 of the first-described apparatus is replaced by two separate second stepping motors 190 and 192, respectively, of which each is directly associated with an associated portal 182 and 184, respectively. Thus the synchronous drive by means of toothed belt drives 62 of the first-described apparatus is omitted and independent vertical displacement of elements displaceably connected in the first portal and in the second portal, respectively, is realized. The displacement means at the respective outer side pieces 44 of the two portals are retained without change.

The first portal 182 carries the needle supply device including gripper 92 and insertion plunger 112, with this gripper 92 also performing the function, as in the case of the first-described apparatus, of the extraction device in the needle removing device.

The second portal 184 carries the first sensor 90 for evaluation of the needles as well as ejection plunger 86. The application and operation of these devices is the same as in the first-described apparatus but is now divided appropriately to the two mentioned separate portals 182 and 184.

The drive and control unit 70 according to FIG. 1*b* now combines, in an appropriately modified form, the drive and control means for the two separate portals 182 and 184 to realize the above-described desynchronized movement of these two portals, thus increasing the operating speed of the overall apparatus. Accordingly, for example, the now separate first and second setting motors are driven correspondingly independently.

According to a second distinguishing aspect, the first sensor 90 provided for the evaluation of individual needles 88 is an opto-electric sensor in the form of a laser scanner or a photoelectric image comparison device. Unit 194 of this sensor 90 is attached to the second portal 184, offset by the distance of several needle bores 89 to lag behind in the direction of the scanning movement for the needles to be evaluated, for example by the horizontal spacing of five needle bores in one horizontal row of needles. Unit 194 is here adjustable by means of a displacement unit 194 in the axial direction of needle bores 89 to different lengths of needles 88. Customary in the trade are needles having overall lengths of 3" and 3.5". It is desirable for sensor 90 to have a constant distance from the needle tip of a newly inserted needle and from a vertical plane applied to all such needle tips, independently of the length of a needle. Additionally, displacement unit 194 is adjustable, either continuously or between at least two discrete positions, so that, in one position, it is oriented axially toward the associated needle bore 89 but in a pivoted-out position can be pivoted obliquely toward the needle so as to optically examine or co-examine side regions of the needle. A corresponding pivot and angle adjustment device 196 for this purpose is provided at displacement unit 194.

This second modification aspect may also be provided in the same sense with other first sensors 90 and/or at a common portal 40, 42, 44 according to the first-described apparatus.

According to a third modification aspect, which may also be provided independently of the first and second modification aspects, instead of the guide 78 which is only locally carried along and is described in connection with the first apparatus, there is now provided a clamping arrangement 198 which grips both longitudinal edges of the needle board 6 in a force locking manner and sets them straight. This clamping device includes a clamping rail understructure 200 which extends along the upright needle board, e.g. the illustrated rectangular profiled tube fastened to base plate 2.

Clamping rail understructure 200 is provided with a clamping rail 202 which is fastened to the former along the clamping rail understructure.

Clamping rail 202 forms an angular profile with a horizontal arm 204 and a vertical arm 206. The longitudinal lower edge of needle board 6 rests in horizontal arm 204 and is tensioned against vertical arm 206 by means of hydraulically actuated clamping jaws 208 which are distributed at given distances along clamping rail 202.

Parallel to lower clamping rail 202 and above it, there is provided an upper clamping rail 210 which is adjustable in height and includes a downwardly extending vertical arm 212 and a horizontal arm 214. Vertical arm 212 again serves to support the rear of the needle board against a further row of hydraulically actuated clamping jaws 208, while horizontal arm 214 comes to lie against the upper longitudinal edge of the upright needle board 6. The height adjustability of upper clamping rail 210 is provided so as to adapt it to various widths of needle boards 6.

To adjust the height of the upper clamping rail 210 relative to lower clamping rail 202, a pair of linear guide posts 216 is disposed at each lower end of the clamping rails on the understructure to both sides of the needle board to be accommodated Linear ball guides 218 engage in these linear guide posts at the two ends of the upper clamping rail 210 so as to be longitudinally displaceable. The linear guide posts themselves are each rigidly connected by means of an upper connecting carrier 220. A traveling nut 222 is rotatably mounted centrally in each connecting carrier 220, with a vertical threaded spindle 224 whose lower end is fastened to the top of the upper clamping rail 210 engaging in each traveling nut.

Connecting carrier 220 also supports a mount 226 on which a stepping motor 228 is provided for vertical displacement of the upper clamping rail 210. To accomplish this, a toothed belt 230 driven by a drive pinion of stepping motor 228 moves around a toothed pulley 232 which preferably projects at the upper exterior face of connecting carrier 220 and is rigidly connected with traveling nut 222. A revolution of toothed belt drive 232 causes threaded spindle 224 to travel upward or downward depending on the direction of rotation of stepping motor 228.

This clamping device 198 replaces the adjustment devices 32, 72 with 74 and 80 of the first-described apparatus. The positioning pin 38 already mentioned in connection with the first-described apparatus is here advisably disposed at the lower clamping rail 202 which is stationary in the present modification. In order to provide a particularly rigid arrangement, linear guide posts 216 are advisably connected with the clamping rail understructure by way of correspondingly stiff mounts 234.

The present disclosure relates to the subject matter disclosed in Federal Republic of Germany application, Ser. No. P 37 43 979.0 of Dec. 23, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable;

a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle; and a bore coordinate sensor which measures the degree of flushness of the needle with the axis of an open needle bore and a readjustment device controlled by said bore coordinate sensor, said readjustment device actuating, after actuation of the needle removing device, the follow-up control for the axial alignment of an action axis of the needle supplying device with the open needle bore.

2. The apparatus as defined in claim 1, wherein the first sensor is disposed at an adjustable distance from the imaginary tangential plane at the tips of usable needles.

3. The apparatus as defined in claim 2, wherein the first sensor is disposed in the imaginary axial extension of the needle bore.

4. The apparatus as defined in claim 2, wherein the first sensor is displaceable between a first position in which it is disposed in the imaginary axial extension of the needle bore and at least one further position in which it is disposed to the side of the first position.

5. The apparatus as defined in claim 2, wherein the first sensor is a laser scanner.

6. The apparatus as defined in claim 2, wherein the first sensor is a photoelectric image comparison device.

7. The apparatus as defined in claim 1, wherein a clamping device is provided which grips two longitudinal edges of the needle bore in a force locking manner and straightens the edges.

8. The apparatus as defined in claim 1, wherein the first sensor is disposed at least partially alongside the usable needles.

9. The apparatus as defined in claim 8, wherein the first sensor includes two facing sensor elements.

10. The apparatus as defined in claim 1, wherein the board receiving device receives the needle board in a position in which it is upright on one of its longitudinal edges.

11. The apparatus as defined in claim 10, wherein the board receiving device includes adjustment devices for adapting it with respect to the length, thickness and width of the needle board to be accommodated.

12. The apparatus as defined in claim 1, wherein the needle removing and supplying devices are carried by a common U-shaped portal.

13. The apparatus as defined in claim 12, wherein, in one coordinate direction, the drive and control unit displaces the U-shaped portal along the board receiving device and in the other coordinate direction it displaces the needle removing and supplying devices relative to the U-shaped portal.

14. The apparatus as defined in claim 1, wherein the needle supplying device and the extraction device of the needle removing device are carried by a first portal and the first sensor as well as the ejection plunger of the needle removing device are carried by a second portal; and both portals are adjustable independently of one another at both sides of the needle board.

15. The apparatus as defined in claim 14, wherein, in different positions of their portals, the first sensor and the ejection plunger are oriented toward the same needle board.

16. The apparatus as defined in claim 1, wherein the first sensor and the bore coordinate sensor are disposed at an adjustable distance from the imaginary tangential plane at the tips of usable needles.

17. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, wherein the first sensor is disposed at an adjustable distance from the imaginary tangential plane at the tips of usable needles and wherein at least one clearing element which is carried along during the addressing of the needle bores engages in a space between two needle rows.

18. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, wherein a guide is provided which is carried along during the addressing of the needle bores so as to engage at longitudinal edges of the needle board and, within the region of the needle removing and supplying devices, and hold the board at a constant distance relative to said devices.

19. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, and including a means for rotating the gripper so as to orient the needle tricks and wherein a clamping device grips two longitudinal edges of the needle board in a force-locking manner and straightens the edges.

20. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, wherein a vibratory conveyor is provided which receives a supply of new needles and includes a subsequent needle separating and supplying device for the successive transfer of needles to the gripper with a given trick orientation and wherein a clamping device grips two longitudinal edges of the needle board in a force-locking manner and straightens the edges.

21. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, wherein, in the gripper, gripper fingers and an insertion plunger provided with a magnetic head are arranged coaxially and wherein a clamping device grips two longitudinal edges of the needle board in a force-locking manner and straightens the edges.

22. An apparatus for automatically removing or supplying needles having tricks in needle boards, the apparatus comprising:

a board receiving device;

a needle supplying device which successively individually addresses needle bores of the needle board by way of a drive and control unit, and includes a device for making needles available to supply the needles individually to an insertion plunger and to orient the tricks of the needles in proper position;

a needle removing device which includes an ejection plunger on a side of the needle board facing away from the needle supplying device and an extraction device comprising a gripper on a side of the needle supplying device and both devices moving along with the needle supplying device;

a first sensor carried along on a side of the ejection plunger for the evaluation of a needle contained in the respectively addressed needle bore as usable or no longer usable; and a selection control controlled by said sensor which, if the respective needle is considered to be usable, causes the next needle bore to be addressed but, if the needle is evaluated as no longer usable, first puts the needle removing device and the needle supplying device into successive operation for the exchange of a needle and additionally, if the needle is evaluated as no longer usable, causes the ejection plunger to be actuated if the needle evaluated as no longer usable is flush with the needle bore and brings the needle supplying device to the needle bore of the needle evaluated as no longer usable and puts the extraction device as well as the needle supplying device into operation successively for the exchange of a needle, wherein a gripper is provided which, as a component of the needle removing device, serves to extract the old needle previously displaced in the needle bore by the ejection plunger and simultaneously, as a component of the needle supplying device, serves to insert new needles into the free needle bores before they are pressed in.

23. The apparatus as defined in claim 22, wherein the gripper is attached to a pivot head.

24. The apparatus as defined in claim 23, wherein the pivot head also carries the bore coordinate sensor.

* * * * *